United States Patent [19]

Wallis

[11] 4,174,648

[45] Nov. 20, 1979

[54] PUNCH RETAINER

[76] Inventor: Bernard J. Wallis, 25200 Trowbridge Ave., Dearborn, Mich. 48123

[21] Appl. No.: 951,756

[22] Filed: Oct. 16, 1978

Related U.S. Application Data

[63] Continuation-in-part of Ser. No. 874,230, Feb. 1, 1978, abandoned.

[51] Int. Cl.[2] ..... B26D 7/26; B26F 1/14

[52] U.S. Cl. ..... 83/698; 279/28; 279/30; 279/77; 279/79

[58] Field of Search ..... 279/77, 76, 79, 30, 279/29, 28, 87, 697, 15 G; 83/698, 700

[56] References Cited

U.S. PATENT DOCUMENTS

| | | | |
|---|---|---|---|
| 1,621,811 | 3/1927 | Richard et al. | 83/698 X |
| 1,784,911 | 12/1930 | Schlitters et al. | 279/77 X |
| 1,797,987 | 3/1931 | King | 279/77 |
| 1,910,275 | 5/1933 | Alden | 279/77 |
| 1,974,217 | 9/1934 | Richard | 279/77 |
| 2,580,930 | 1/1952 | Kost | 279/79 X |

*Primary Examiner*—Donald R. Schran

*Attorney, Agent, or Firm*—Barnes, Kisselle, Raisch & Choate

[57] ABSTRACT

A punch and retainer assembly wherein the punch has a flattened surface at the upper end of the side wall thereof and a radially inwardly extending recess directly below the flattened side wall portion. The punch retainer includes a vertically movable latch adapted to engage within the recess on the shank of the punch and retain the punch within the retainer block. Means are provided for limiting vertical movement of the latch so that the punch can be inserted into the retainer only when the flattened surface thereof is aligned parallel with the pivot axis of the latch.

16 Claims, 11 Drawing Figures

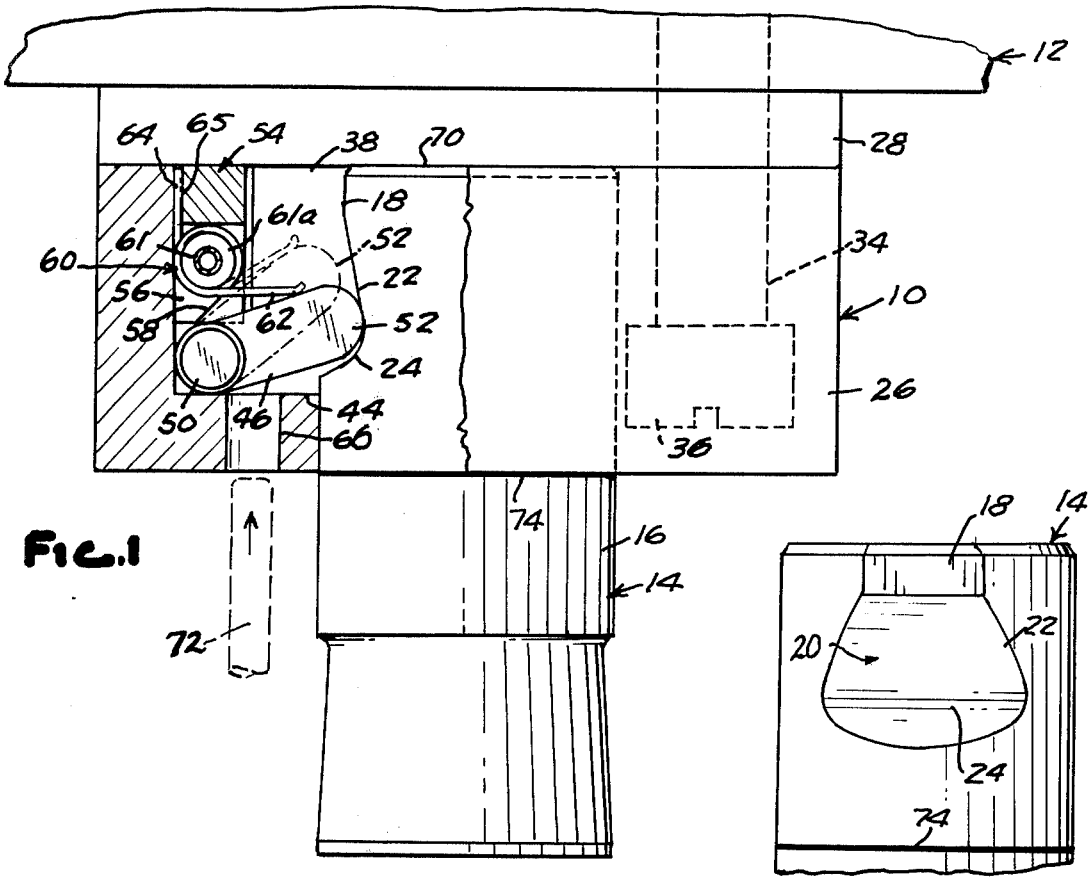
FIG. 1
FIG. 3
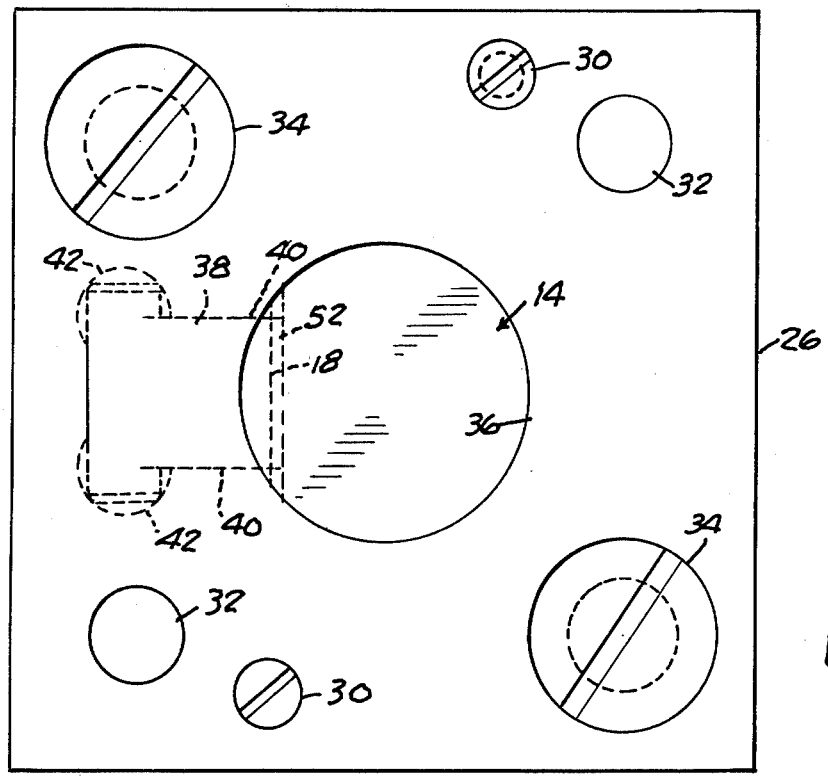
FIG. 2

PUNCH RETAINER

This application is a continuation-in-part of applicant's prior co-pending application Ser. No. 874,230, filed Feb. 1, 1978, now abandoned.

This invention relates to a punch retainer for use on stamping presses.

With most presses, punches are retained in bores of a retainer block mounted on a reciprocating die shoe. It frequently becomes necessary to replace one or more punches because of wear, differently sized holes, etc. It is, therefore, desirable to provide a design for the punch and the retainer which permits easy removal and replacement of punches. In connection with the replacement of punches, it is also important that the design is such that full seating of the punch in the retainer in a properly oriented position is assured.

An object of this invention is to provide a punch and retainer assembly designed for quick and easy removal and replacement of the punches.

Another object of this invention is to provide a punch and retainer assembly which is designed to eliminate the need for close tolerances with respect to the arrangement for retaining the punch in the retainer block in its properly seated position.

A more specific object of the invention resides in the provision of a punch and retainer assembly which assures that a punch is properly seated in the retainer block, an improper seating of the punch being readily visually indicated.

Other objects, features and advantages of the present invention will become apparent from the following description and accompanying drawings, in which:

FIG. 1 is a side elevational view of a punch and retainer block with parts broken away;

FIG. 2 is a top plan view of the retainer block with the punch mounted therein;

FIG. 3 is a fragmentary side elevational view of the punch;

Figure 4:
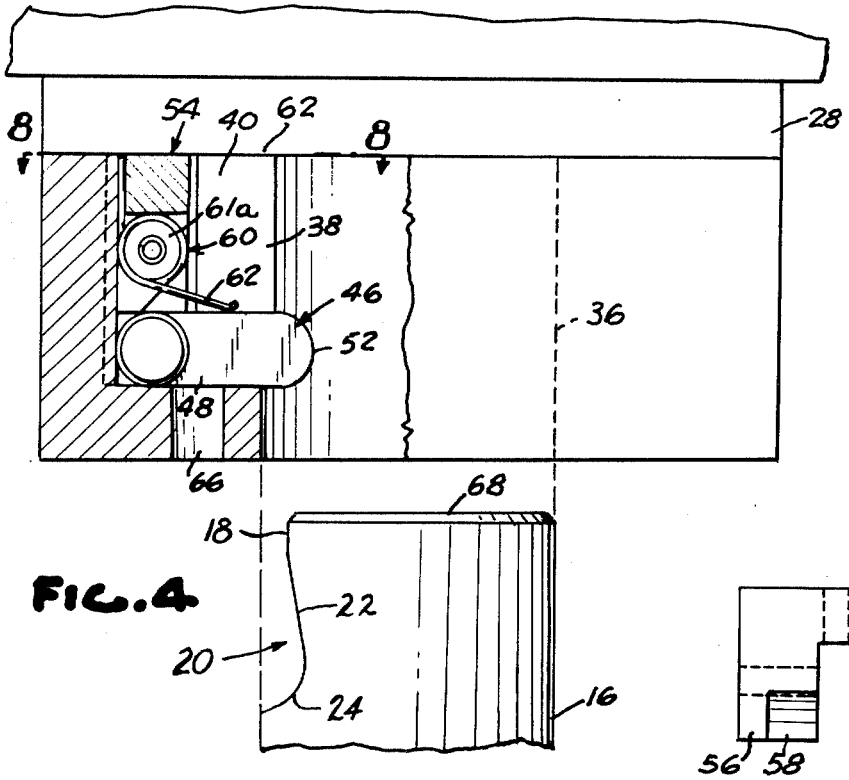
FIG. 4 is a fragmentary view, with parts broken away, of the retainer block in the condition for accepting a punch.
Figure 6:
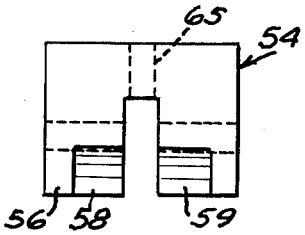
FIG. 6 is a side elevational view of the retainer for the latch.
Figure 7:
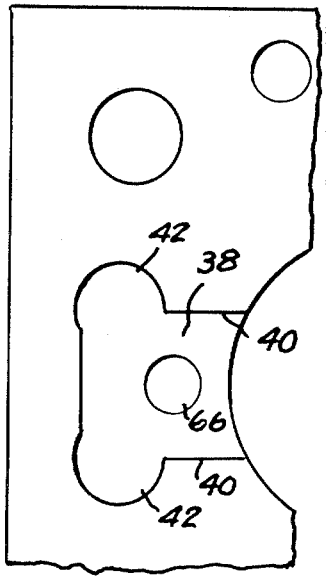
FIG. 7 is a fragmentary top plan view of the body portion of the retainer block.
Figure 8:
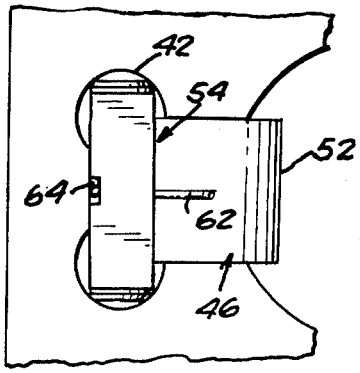
FIG. 8 is a fragmentary top view of the retainer block and latch.

In FIG. 1 there is shown a punch retainer block 10 mounted on an upper reciprocating die shoe 12 and having a punch 14 retained in block 10. Punch 14 has a generally cylindrical shank 16, the side wall of which is ground with a flat 18 adjacent the upper end of the punch. A recess 20 is also formed on the side wall of the punch directly below the flat 18. Recess 20 preferably comprises a flat inwardly inclined face 22, the lower end of which is tangent to a curved face 24.

Punch retainer block 10 comprises a lower body portion 26 and an upper cap plate 28 which are secured together by screws 30 (FIG. 2). Retainer block 10 is accurately located on die shoe 12 by dowel pins 32 and is firmly secured thereto by screws 34.

Figure 5:
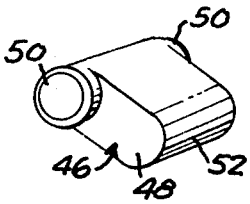
FIG. 5 is a perspective view of the punch engaging latch.

Body 26 of retainer block 10 is formed with an accurately cylindrical bore 36 adapted to snugly receive the shank 16 of punch 14. At one side of bore 36 body 26 is formed with a socket 38 extending downwardly from the top face thereof. The portion of socket 38 which intersects bore 36 is defined by two parallel vertically extending side walls 40. The laterally outer end portion of socket 38 is enlarged at each side thereof as at 42 so that in horizontal section socket 38 is of generally T shape. The bottom face 44 of the socket is flat and generally perpendicular to the axis of bore 36. On the bottom face 44 of socket 38 there is supported for swinging movement a latch 46. As shown in FIG. 5, latch 46 comprises a generally rectangular body portion 48 having a pair of laterally opposite extensions 50 at one end thereof of cylindrical shape. The other end of body portion 46 comprises a nose 52 of cylindrical shape. The axis of cylindrical nose 52 is parallel to the axis of cylindrical extensions 50.

Latch 46 is pivotally retained within socket 38 by means of a generally inverted U-shaped retainer block 54. Block 54 is dimensioned in width so as to overlie the cylindrical extensions 50 on latch 46 which are seated in the enlargements 42 of the socket. The lower portion of each leg 56 of retainer 54 which faces bore 36 is formed with a triangularly-shaped cavity 58. The width of cavities 58 across the two legs 56 accommodates the rectangular body portion 48 of latch 46 and permits swinging movement of latch 46 in an upward direction from the position illustrated in FIG. 4. The inclined face 59 of cavity 58 limits the upward swinging movement of latch 46 to the broken line position shown in FIG. 1. Latch 46 is normally urged downwardly to its lowermost position shown in FIG. 4 by a torsion spring 60 retained on a pin 61 which spans the two legs 56 of block 54. Spring 60 encircles a bushing **61*a* on pin 61. One leg 62 of spring 60 bears downwardly on the top face of body portion 48. The other leg 64 of spring 60 is retained in place within a groove 65 on the outer face of the retainer block 54. The assembly of latch 46, retainer block 54 and spring 60 is retained in place within socket 38 by the top cap 28 of retainer block 10. The bottom face of the retainer block body portion 26 is provided with a small vertical bore 66 which intersects socket 38 directly below the body portion 48 of latch 46**.

It will be observed, as shown in FIG. 1, that, when latch 46 is pivoted upwardly to its uppermost position wherein it engages the inclined face 59 of cavity 58, the nose portion 52 projects into bore 36 a distance only sufficient to clear the flat 18 at the upper end of the punch when the punch is circumferentially oriented so that the flat 18 is parallel to the pivot axis of latch 46. This is an important feature of the present invention.

When a punch is removed from retainer block 10 latch 46 is biased by spring 60 to assume the position shown in FIG. 4 wherein it projects substantially into bore 36 and lies in a plane substantially perpendicular to the axis of bore 36. When it is desired to insert the punch in bore 36, the punch is rotated about its vertical axis to a position wherein the flat 18 is aligned generally parallel with the nose 52 of latch 46; that is, parallel to the pivot axis of the latch. Thereafter the punch is pushed upwardly into bore 36. Upon insertion of the punch in bore 36 the upper edge of flat 18 engages nose 52 of latch 46 and pivots the latch upwardly to substantially the broken line position shown in FIG. 1 so that the upper flat end 68 of the punch becomes seated against the bottom face 70 of cap plate 28. It will be noted, however, that as the shank of the punch is moved progressively upwardly in bore 36, after the nose 52 of the latch clears the flat 18, the latch pivots downwardly to the extent permitted by the vertical displacement of the inclined face 22. The radial depth of recess 20 in relation to the length of latch 46 is such that, when the upper end 68 of the punch bottoms against the bottom face 70 of cap plate 28, latch 46 has pivoted downwardly under the bias of spring 60 to the position shown in solid lines in FIG. 1. In this position latch 46 is slightly non-perpendicular to the flat face 22 of recess 20. Stated differently, when the punch is fully seated within the retainer 10, the nose 52 of latch 46 engages the flat face 22 of recess 20 with a wedging action. With the latch 46 engaging the punch with wedging action as shown in FIG. 1, it is impossible to retract the punch downwardly from within bore 36.

In order to remove the punch from within the retainer 10 a pin 72 is inserted upwardly through the opening 66 to pivot latch 46 upwardly out of wedging engagement with face 22 and against the bias of spring 60. When the latch 46 assumes the broken line position shown in FIG. 1, punch 14 can be fully retracted within bore 36 since the nose 52 of the latch will now clear the flat 18 at the upper end of the punch.

Punch 14 preferably has a ring or other indicia 74 thereon located so as to be flush with the bottom face of retainer 10 when the punch is fully inserted into the retainer block. This provides a visual indication to the operator as to whether or not the punch is fully seated. In addition, it will be noted that if the punch is initially inserted upwardly into cavity 36 in a position oriented such that the flat 18 is not parallel with the pivot axis of the latch, it will be impossible to insert the punch fully within the retainer block 10. Nose 52 of the latch will engage the upper end of the punch. Thus, the flat 18 prevents the possibility of the punch being unknowingly inserted only partially in the retainer block 10. It will also be appreciated that the likelihood of wear in the retaining mechanism for the punch is minimized because nose 52 contacts flat face 22 across the entire width of the rectangular latch. Thus, the particular arrangement illustrated and described provides a substantially larger bearing surface between the latch and the punch than would normally be obtained by using a spring-pressed bearing ball for engaging the punch in the seated position.

Figure 9:
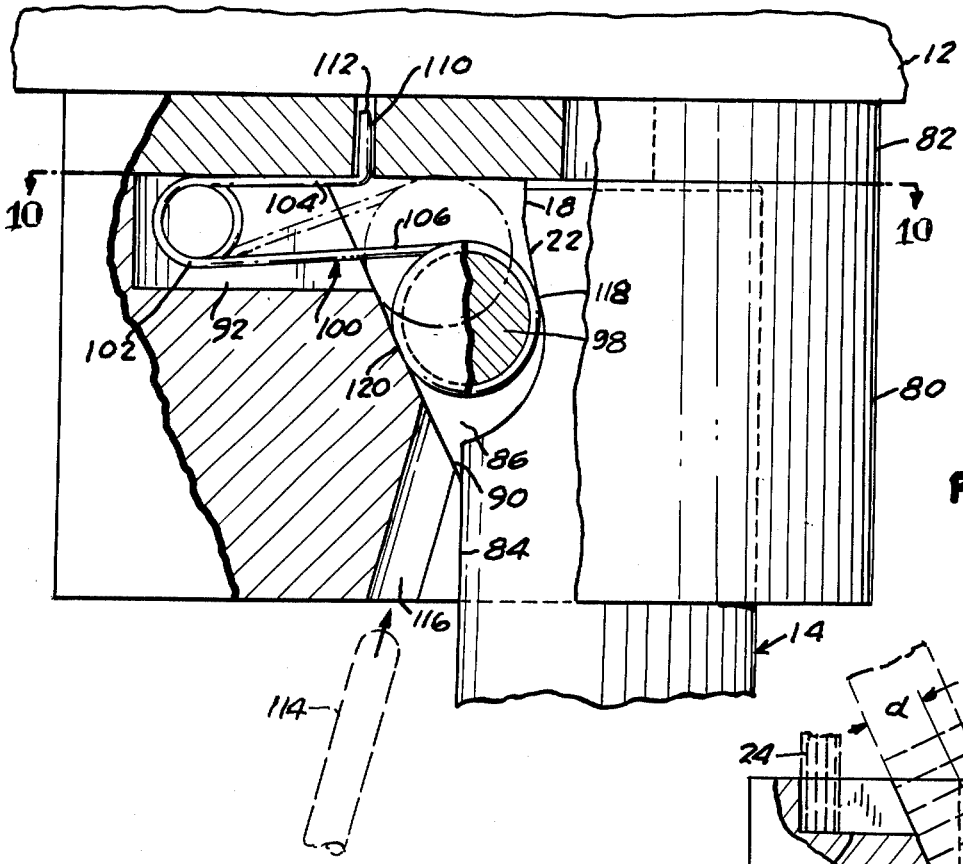
FIG. 9 is a view similar to FIG. 1 and showing a modified form of punch retainer.
Figure 11:
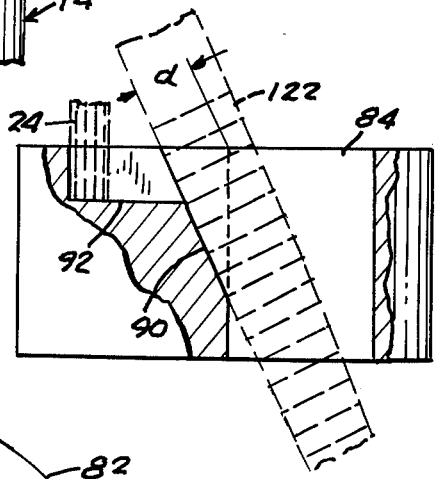
FIG. 11 is a side elevational view of the retainer block with parts broken away to illustrate the manner in which the punch/latch socket is formed therein.
Figure 10:
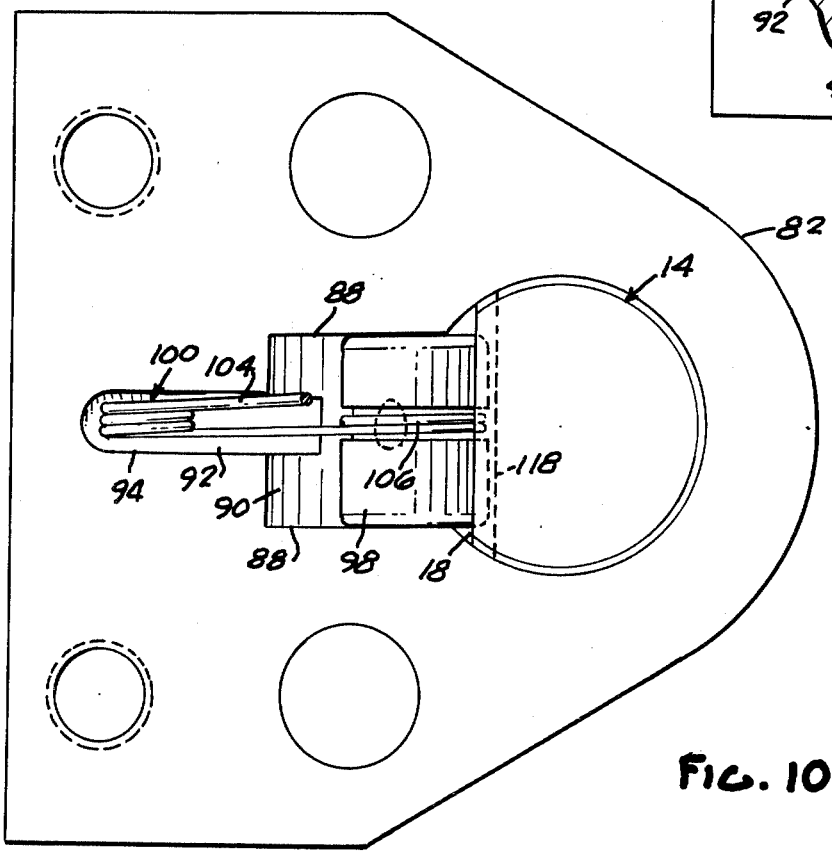
FIG. 10 is a sectional view along the line 10—10 in FIG. 9.

The arrangement illustrated in FIGS. 9 through 11 differs in some respects from that shown in FIGS. 1 through 8 but embodies the desirable features and advantages of the assembly previously described. In the embodiment illustrated in FIGS. 9 through 11 the punch 14 is constructed identically with the punch previously described. However, the lower body portion 80 and the upper cap plate 82 differ slightly from those previously described. Body 80 is formed with an accurately cylindrical bore 84 adapted to snugly receive the shank of the punch. At one side of bore 84 body 80 is formed with a socket 86 in the form of a slot having a rectangular cross section, the side walls of which are designated 88 and the bottom wall of which is designated 90. The flat bottom wall 90 extends downwardly from the top face of body 80 and is inclined in a direction readially inwardly of bore 84. Adjacent its upper end, socket 86 is formed with a rearward extension 92 in the form of a slot having side walls 94 and a bottom wall 96. The bottom wall 96 is preferably perpendicular to the axis of bore 84.

The means for retaining punch 14 seated in the block comprises a cylindrical roller 98 supported within socket 86 by a torsion spring 100. Torsion spring 100 has a coiled section 102 within slot 92 having spring legs 104,106 extending therefrom through slot 92 toward socket 86. The end of spring leg 106 extends circumferentially around roller 98 within a groove 108 at the central portion thereof. The end of spring leg 104 is bent upwardly as at 110 and extends into an opening 112 in the upper cap plate 82 with a relatively loose fit. Spring 100 normally biases roller 98 downwardly in socket 86. In its uppermost position wherein the roller 98 abuts against the bottom face of upper cap plate 82, the broken line position shown in FIG. 9, roller 98 projects into bore 84 and just clears the flat 18 at the upper end of the punch when the punch is circumferentially oriented so that the flat 18 is parallel to the axis of roller 98.

When the punch is seated in bore 84 in the position shown in FIG. 9 it may be removed therefrom by inserting a tool 114 upwardly through a bore 116 in body 80 to displace roller 98 against the bias of spring 100 to the broken line position. As pointed out previously, in this position roller 98 just clears the flat 18 on the punch and enables the punch to be withdrawn from bore 84. When the tool 114 is retracted roller 98 will assume the approximate position shown in FIG. 9 under the bias of spring 100. When it is desired to insert the punch in the bore, the punch is pushed upwardly and the upper edge of flat 18 engages roller 98 and displaces it upwardly and inwardly of socket 86, which movement is permitted by spring 100 and the loose fit of the spring end 110 in opening 112. As the shank of the punch is moved progressively upwardly in socket 86 and after the roller clears the flat 18, spring 100 displaces roller 98 downwardly progressively until the upper end of the punch is seated against the top cap plate 82. At this time roller 98 tangentially engages the flat inclined face 22 on the punch with line contact at 118. The opposite side of the roller is in tangential engagement with the flat wall 90 of socket 86 with line contact at 120. Roller 98 is thus engaged in wedge relation with both punch 14 and the inclined face 90 of the socket in the retainer body. It thus becomes impossible to retract the punch downwardly from within bore 84 until roller 98 is displaced upwardly by means of tool 114.

In order to obtain the firm wedge gripping relationship between the roller and the punch it is essential that the flat face 22 on the punch and the flat face 90 of socket 86 incline toward one another. The included angle between these two faces preferably lies in the range of 7° to 10°. Thus, the face 22 is preferably inclined to the axis of bore 84 at an angle of about 15°. When face 22 is so inclined face 90 is inclined to the axis of bore 84 at an angle of approximately 22° to 25°.

It will be appreciated that the diameter of roller 98 is determined to a large extent by the depth of the slot forming socket 86. In the embodiment illustrated the flat bottom wall 90 of socket 86 is so located as to permit the socket to be formed by a broaching operation such as shown in FIG. 11. The broach is designated 122. It will be noted that the inclination of bottom wall 90 and the depth d of the slot defining socket 86 are such that the broaching tool 122 passes through the lower end of bore 84 without interference. The extension 92 of socket 86 is machined by means of a conventional milling cutter 124. Thus, the arrangement illustrated in FIGS. 9 through 11 possesses all of the advantages of the previously described embodiment and, in addition, is adapted to be machined more economically.

I claim:

1. In combination, a punch having a shank of circular cross section, said shank having a flat side wall portion extending lengthwise of the punch to the upper end thereof, said shank having a radially inwardly extending recess at the lower end of said flat side wall portion, a retainer having a vertically extending circular bore therein sized to receive said shank and abutment means against which the shank is adapted to bottom when the punch is inserted upwardly therein, said retainer also having a socket therein opening at one side thereof into said bore, a latch supported at one end thereof in said socket for pivotal movement about a horizontal axis spaced radially from said bore, the opposite end of said latch being adapted to engage said recess when the upper end of the punch shank is inserted axially into said bore to retain the punch therein, means biasing said latch to pivot downwardly and means in said socket limiting the pivotal movement of said latch in an upward direction to a position wherein the punch-engaging end of the latch just clears the flat side wall portion on the shank of the punch whereby the punch can be inserted into said bore to interengage the latch with the flat side wall portion of the shank only when the punch is oriented with the flat side wall portion aligned parallel with the pivot axis of said latch, the punch engaging end of said latch comprising a generally cylindrical surface extending parallel to the pivot axis of the latch, said recess including a generally flat latch-engaging surface extending downwardly and radially inwardly from the lower end of said flat side wall portion, said latch being inclined upwardly from its pivot axis with its punch-engaging end engaging said flat latch surface in a wedging relation when the punch bottoms against said abutment means.

2. The combination called for in claim 1 wherein the included angle between said latch and said flat latch-engaging surface on the punch is only slightly less than 90° when the upper end of the shank bottoms against the abutment means in the bore of the retainer.

3. The combination called for in claim 1 wherein said means for limiting pivotal movement of said latch comprises means in said socket positioned above said latch and having a face portion adapted to be engaged by the latch which is inclined downwardly and away from said bore.

4. The combination called for in claim 1 wherein said latch comprises a plate member having a generally rectangularly-shaped body portion, said socket having vertically extending side walls spaced apart to slideably engage the side edges of said body portion.

5. The combination called for in claim 4 wherein the latch also has opposed laterally outwardly extending projections at one end of said body portion which provide a pivotal support for the latch in said socket.

6. The combination called for in claim 5 wherein said projections are of cylindrical shape and coaxially aligned.

7. The combination called for in claim 6 wherein said socket has vertical slots at opposite sides thereof for accommodating said projections.

8. In combination, a punch having a shank of circular cross section, said shank having a flat side wall portion extending lengthwise of the punch to the upper end thereof, said shank having a radially inwardly extending recess at the lower end of said flat side wall portion, said recess comprising a flat face which is inclined downwardly and radially inwardly, a punch retainer block having a vertically extending circular bore sized to receive said shank with a close fit and also having abutment means therein against which the upper end of the shank is adapted to bottom when the punch is inserted upwardly into said bore, said retainer also having a socket therein offset radially from said bore and opening at one side thereof into said bore, said socket having at least one flat side wall at the radially outer side thereof disposed radially opposite the flat face on the shank when the punch bottoms against said abutment means, a punch latch in said recess having diametrically opposed cylindrical contact surfaces, means in said socket biasing said latch downwardly to a position wherein one of said cylindrical contact surfaces is engaged in tangential line contact with the flat side wall of the socket and the other is in tangential line contact with the flat face on the punch shank in wedging relation thereto when the upper end of the punch bottoms against said abutment means, means in said socket limiting upward movement of the latch to a position wherein the punch engaging contact surface of the latch just clears the flat side wall portion of the punch whereby the punch can be inserted into said bore to interengage the latch with the inclined face of the shank recess only when the punch is oriented with its flat side wall portion aligned parallel with the axis of the cylindrical contact surface of the latch, said latch and said inclined flat face of said recess being arranged such that when the upper end of the punch bottoms against said abutment means a line through the latch perpendicular to the tangential line of contact between the latch and the punch is inclined upwardly in a radially inward direction.

9. The combination called for in claim 8 wherein said latch is pivotally supported in said socket by causing one cylindrically shaped end portion thereof to bear against the flat side wall of the socket.

10. The combination called for in claim 8 wherein said latch comprises a cylindrical roller and said side wall of the socket inclines downwardly and radially inwardly toward the bore in the retainer block.

11. The combination called for in claim 10 wherein the flat face on the punch shank and said side wall of the socket inclined toward each other when the upper end of the punch is seated against said abutment means and the cylindrical roller is engaged between the flat side wall of the socket and the flat face of the punch.

12. The combination called for in claim 11 wherein the included angle between the side wall of the socket and the flat inclined face on the punch is between approximately 7° to 10°.

13. The combination called for in claim 11 wherein the planar extension of said socket side wall passes downwardly through said bore at the lower end of the retainer block without intersecting the circle defined by the lower end of the bore.

14. The combination called for in claim 11 wherein the retainer block comprises a body portion having a generally flat upper face and a top plate secured on the upper face of said body, said top place comprising said abutment means, said inclined side wall of the socket extending downwardly from the top face of the body to said bore.

15. The combination called for in claim 14 wherein said socket comprises a slot in said retainer of generally rectangular cross section, the bottom wall of said slot comprising the inclined side wall of said socket.

16. The combination called for in claim 15 wherein the planar extensions of the side walls and bottom wall of said slot pass through the lower end of the bore without intersecting the circle defined by said bore at the lower end of said body.

* * * * *